US007744163B2

(12) United States Patent
Opsvik

(10) Patent No.: US 7,744,163 B2
(45) Date of Patent: Jun. 29, 2010

(54) FASTENING BRACKET FOR A CHAIR

(75) Inventor: Peter Opsvik, Oslo (NO)

(73) Assignee: Peter Opsvik AS, Oslo (NO)

( * ) Notice: Subject to any disclaimer, the term of this patent is extended or adjusted under 35 U.S.C. 154(b) by 0 days.

(21) Appl. No.: 12/280,546

(22) PCT Filed: Feb. 23, 2007

(86) PCT No.: PCT/NO2007/000071

§ 371 (c)(1),
(2), (4) Date: Aug. 22, 2008

(87) PCT Pub. No.: WO2007/097637

PCT Pub. Date: Aug. 30, 2007

(65) Prior Publication Data

US 2009/0045660 A1 Feb. 19, 2009

(30) Foreign Application Priority Data

Feb. 24, 2006 (NO) ..... 20060920

(51) Int. Cl.

| | |
|---|---|
| ***A47D 15/00*** | (2006.01) |
| ***A44B 11/00*** | (2006.01) |
| ***A44B 11/25*** | (2006.01) |
| ***A44B 17/00*** | (2006.01) |

(52) U.S. Cl. ..... 297/467; 297/250.1; 24/182; 24/197

(58) Field of Classification Search ..... 297/467, 297/250.1; 24/182, 193, 196, 197, 200
See application file for complete search history.

(56) References Cited

U.S. PATENT DOCUMENTS

| | | | | |
|---|---|---|---|---|
| 2,324,421 | A | 7/1943 | Ouellette | |
| 4,632,460 | A * | 12/1986 | Meeker et al. | 297/467 |
| 5,775,772 | A | 7/1998 | Lefranc | |
| 6,543,847 | B2 * | 4/2003 | Balensiefer | 297/250.1 |
| 6,588,849 | B2 * | 7/2003 | Glover et al. | 297/467 |
| 2002/0036419 | A1 | 3/2002 | Balensiefer | |
| 2002/0036423 | A1 | 3/2002 | Glover et al. | |

FOREIGN PATENT DOCUMENTS

| | | | |
|---|---|---|---|
| EP | 0747257 | A1 | 12/1996 |
| GB | 2225557 | A1 | 12/1988 |

* cited by examiner

*Primary Examiner*—Rodney B White
(74) *Attorney, Agent, or Firm*—Kolisch Hartwell, P.C.

(57) ABSTRACT

The present invention concerns a fastening bracket for use in a children's chair (1) with a seat plate (2), wherein the seat plate has a vertical opening, characterized in that it comprises: a frame piece (10) comprising a vertical first opening (11), for placement on the underside of the seat plate (2), a lining clip (20) comprising two parallel vertical locking pegs (21) for introduction into the opening in the seat plate (2) from above, wherein the locking pegs (21) are connected together in a first end by a flange (22) and each locking tap having a horizontal pin hole (24) in the other end, wherein the flange (22) has a horizontal extent which is larger than the opening area of the opening in the seat plate (2) and comprising a through going vertical inner opening (25) between the locking pegs (21), and a locking pin (30) comprising at least two parallel arms (31) for introduction into the pin holes (24) in the lining clip (20), wherein the arms (31) are connected together with the pin cross piece (32). The invention also concerns a harness set and the use of the bracket and the harness set.

29 Claims, 5 Drawing Sheets

FASTENING BRACKET FOR A CHAIR

The present invention concerns a fixing bracket for a chair, such as a children's chair with a seat plate, wherein the seat plate has a vertical opening in the front edge. The invention is especially suited for a chair with the possibility for vertical and horizontal adjustment of the seat plate. Further, the invention concerns a harness set for a chair and the use of a fixing bracket and a harness set.

BACKGROUND OF THE INVENTION

It is well known that children, that is children such as from the age when they may sit by themselves (about 6-7 month) until they master sitting safely in a children's chair without falling out (about 2 years), need safety harness securing them sitting safely in children's chairs.

Often conventional harnesses are used, such as those accompanying a children's pram, a children's chair of which may be bought separately. In new children's chairs the harnesses are often anchored by a strap on each side of the seat in integrated fastening means, such as eyes or similar. Such harnesses have the disadvantage that they require integrated fastening means in the chair and also hinder the child in turning the upper body to the side because the straps on each side of the harness must be relative short. This short length of the straps should secure that the child sits safely in the chair, but this hinders and irritates the child.

In later years, a development has evolved in the direction of more countries and regions having their own safety measures for equipment to be used by children, such as in children's chairs and harnesses. This must be taken into account in the development of new children's chairs, but it may be difficult to adapt chairs which have been produced for a long time before such safety provision were put into force. It is especially difficult to perform such adaptations on chairs without making physical interventions in the chairs.

This is for example the case with the Tripp Trapp® children's chair which was developed as early as in 1972 and patented in 1976 and which still is a very popular children's chair in many countries.

The chair is designed to be adjusted in coherence with the body size of the child and therefore has a seat plate and a foot plate which may be moved into different height positions by gliding in tracks in the side pieces and being locked by tightening the distance between the side pieces. The sitting plate may further be adjusted in the depth position by the plate being pushed in relation to the seat support, and thereby providing the child using the chair a correct seat length under the thighs.

It has proven difficult to adapt existing seats to new effective demands, especially in order to keep the above-mentioned original functions of the chair. In order to achieve this, the attachment of a children's harness should be able to follow the height position of the seat.

In addition to fastening a harness to such chairs, it may also be desirable to mount a children's bow, which either may be used alone or simultaneously with the harness.

It is a further objective to provide a fastening means for this additional equipment so that also owners of older chairs may upgrade their chairs. As mentioned, it is also an objective to avoid physical intervention in the chair, such as making holes in some of the parts or inserting screws that leave spoiling marks in the chair which will be visible when the there no longer is any use for the children's equipment. Such adaptations further result in a risk of the user making adaptations in the wrong manner, and that the safety is not kept intact. It is therefore an objective with the invention to make the fastening of the children's equipment as intuitive and simple as possible, upholding safety at the same time and preventing a child from operating the fastening by itself.

US 2002/0036419 shows a system for fastening a harness to a juvenile seat by a retainer attached to the underside of the seat by screws. The retainer has a vertical opening corresponding to an opening in the seat through which the crotch strap with a mount may be conducted and the mount may then be attached to the retainer. The document does not suggest non-marking fastening means of the retainer, and a child would be able to release the mount from the retainer from the underside.

DESCRIPTION OF THE INVENTION

In order to attain these objectives the applicant has developed a fastening bracket for the fastening of children's equipment solving the above-mentioned problems. The bracket may be part of a harness set which is especially suited for use in a children's chair.

The bracket consists of a frame piece for mounting on the underside of the seat plate, a lining clip being threaded through the opening in the seat plate from the topside allowing a part of the children's harness being thread through the opening in the lining and which locks in the frame piece by the help of a locking pin. The bracket may comprise at least one additional fastening means for fixing a bow part to the seat plate.

Thus, the present invention concerns a fastening bracket, a harness set, and the use of this according to the appended claims.

The invention will in the following be described in greater detail by the help of embodiments and the attached drawings, none of which are meant to limit the scope of the invention, which is only defined by the appended claims.

SHORT DESCRIPTION OF THE DRAWINGS

DETAILED DESCRIPTION

The fastening bracket according to the present invention comprises in the following embodiment three parts: a frame piece, a lining clip and a locking pin.

Figure 1:
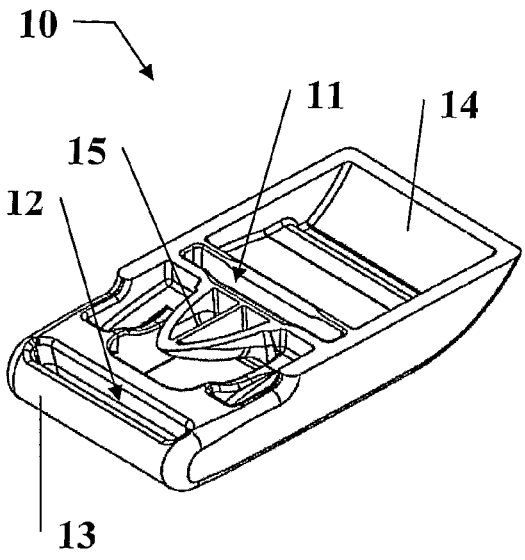
FIG. 1 shows a perspective view of the frame piece of the fastening bracket.

In FIG. 1 the frame piece 10 is shown in perspective from above, that is from the side that will abut the underside of the seat plate it is fastened to. The frame piece 10 in this embodiment has a rectangular form with a decreasing thickness in the rear end 14, one centrally positioned vertical first opening 11, and one vertically slanting second edge opening 12 in the front short edge 13 of the frame piece 10, both openings in the cross direction of the length direction of the frame piece 10. The shape may however be adapted to each chair or the looks desired, such as an oval shape for example.

Figure 2:
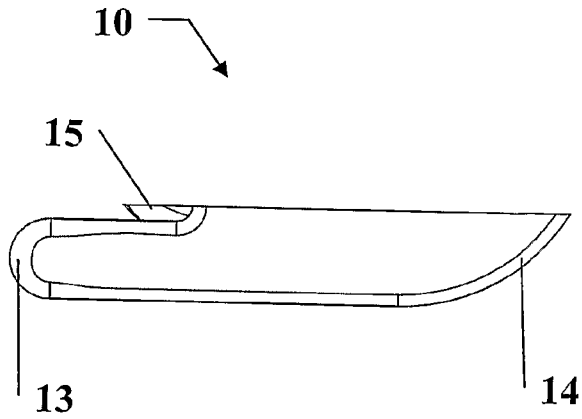
FIG. 2 shows a side view of the frame piece.

In FIG. 2 the frame piece 10 is shown in a side view in the length direction. As may be seen the front end 13 of the frame piece is a rounded shape. The back end 14 has a decreasing thickness towards the upper rear end edge of the frame piece as mentioned.

Figure 3:
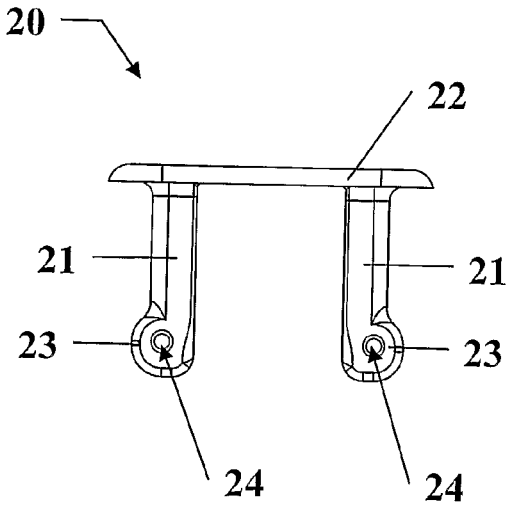
FIG. 3 shows a side view of the lining clip of the fastening bracket.

In FIG. 3 a lining clip 20 is shown in a side view in the cross direction. The lining clip comprises two parallel vertical locking pegs 21, connected together in the upper end by the help of an upper flange 22. The locking pegs 21 comprise expansions in a lower end 23, in this embodiment in the cross direction, with horizontal, through going pin hole 24 in the length direction.

Figure 4:
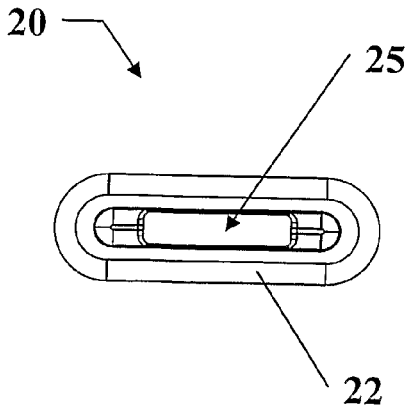
FIG. 4 shows a planar view of the lining clip seen from above.

In FIG. 4 the lining clip in FIG. 3 is shown in planar view from above, wherein it may be seen that the flange 22 comprises a through going inner opening 25 on the inside of the locking pegs 21. The inner opening 25 is adapted to allow the throughput of a part of the harness, such as a crotch strap for a children's harness.

Figure 5:
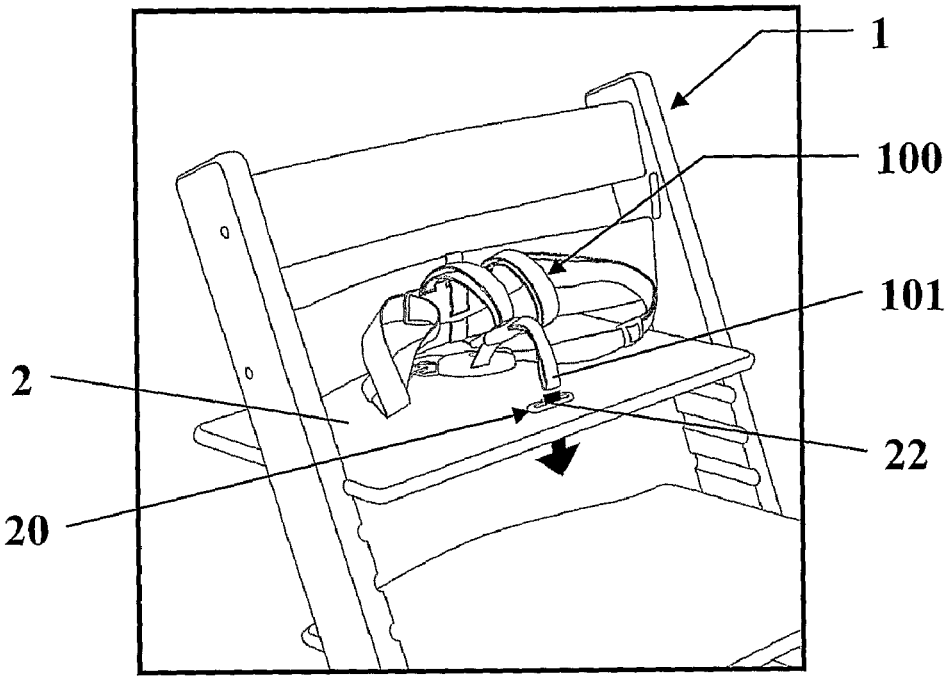
FIG. 5 shows an installation drawing of the lining clip in a seat plate seen from above.
Figure 6:
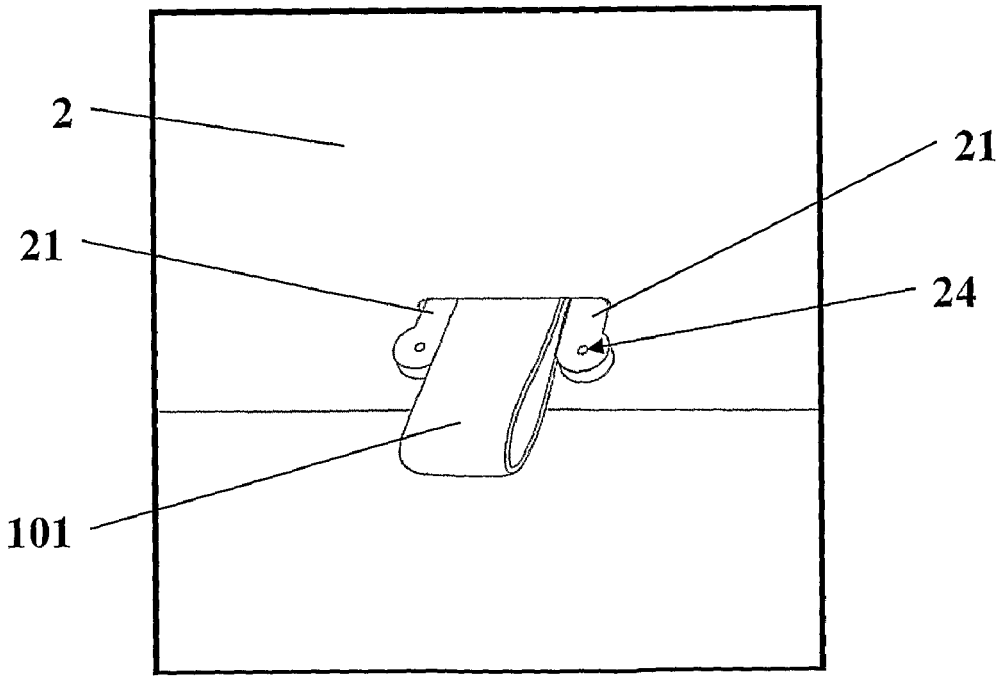
FIG. 6 shows an installation drawing of the lining clip seen from the underside of the seat plate and a harness part.

In FIG. 5 it is shown how the lining clip 20 is put into a opening in the seat plate 2 on a children's chair 1. The lining clip 20 is adapted to the opening in the seat plate so that the flange 22 has a larger horizontal extent than the area of the opening and rests on the topside of the seat plate around the edge of the opening. The inner opening 25 in the lining clip 20 thereby allows a harness part, which is a crotch strap 101 of a children's harness 100 to be directed through the opening 25 and thereby through the seat plate 2 at the same time. In FIG. 6 the lining clip 20, is shown from the underside of the seat plate 2 in that the lower ends of the locking pegs 21 protrude out through the seat plate 2. As may be seen from the figure the crotch strap 101 is also directed through the seat plate 2 between the locking pegs 21, where the outer vertical sides of the locking pegs 21 abut the walls in the opening of the seat plate 2 so that there is no slack. The expansions 23 in the ends of the locking pegs 21 lead in this embodiment to the locking pegs 21 having to be bent somewhat inwards towards each other to pass through the opening in the seat plate during mounting, and that they spring out to the sides on the underside of the seat plate 2 when they are through.

Figure 7:
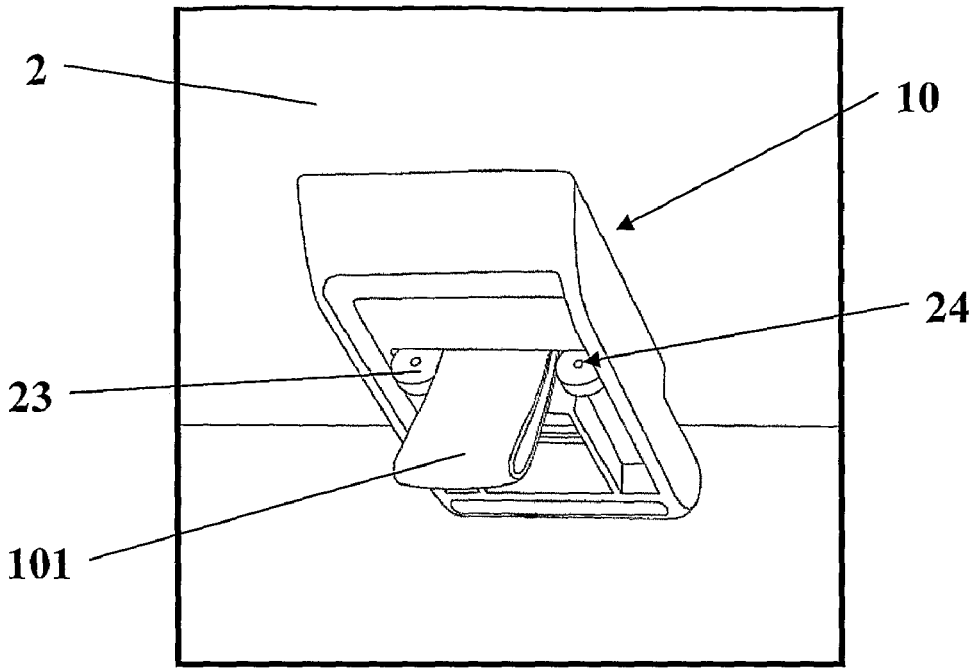
FIG. 7 shows the lining clip in FIG. 5 with frame piece mounted thereon.

In FIG. 7, the frame piece 10 is clasped firmly to the lining clip 20 by the locking pegs 21 also being directed through the middle opening 11 in the frame piece and by the expansions 23 springing out over the lower edge of the first opening 11. The first opening 11 has in principle about the same dimensions as the opening in the seat plate, so that there is no slack in the fastening bracket. The crotch strap 101 is also lead through the first opening 11 of the frame piece 10.

The frame piece 10 and the lining clip 20 are preferably made in a relative stiff material, such as metal, plastic or a composite material, preferably plastic.

Figure 8:
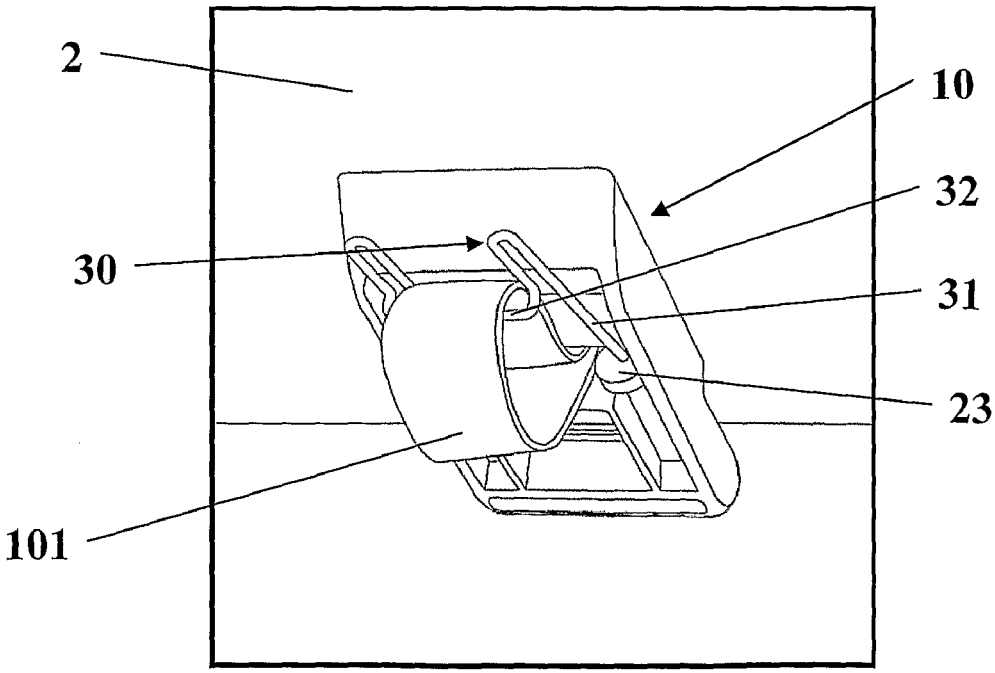
FIG. 8 shows the installation of the bracket according to the invention with a locking pin between the lining clip, the frame piece and the harness part.
Figure 9:
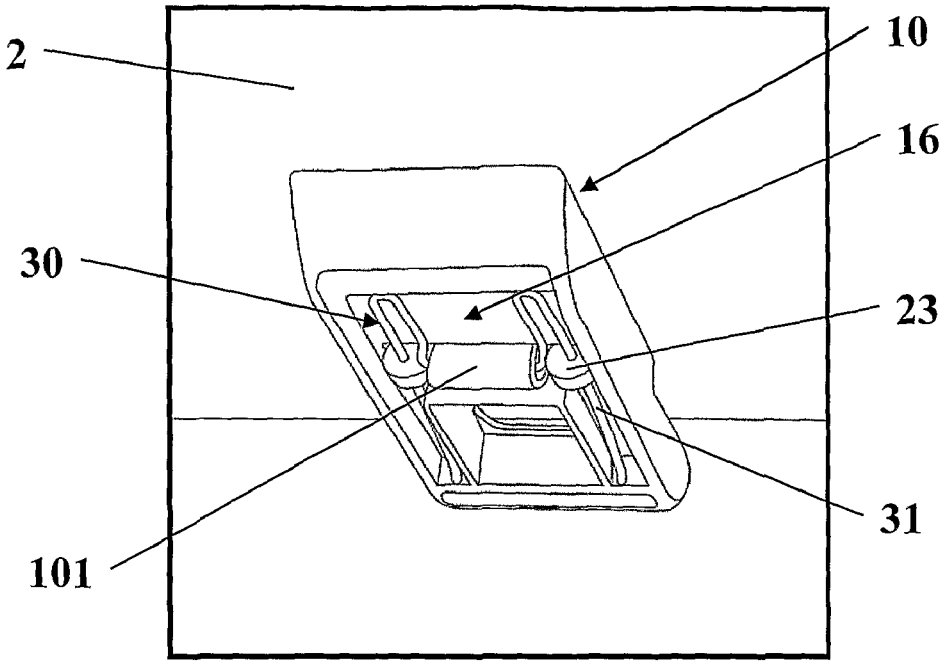
FIG. 9 shows the finished installation of the bracket in FIG. 8.

In order to lock the crotch strap 101 to the bracket, and to secure that the frame piece 10 and lining clip 20 do not split from each other, a locking pin 30 as shown in FIG. 8 is used. The locking pin 30 comprises two parallel arms 31, which in a first end are connected via a pin crosspiece 32. By threading the crotch strap 101 over the pin crosspiece 32 and thereafter threading the arms 32 through the pin holes 24 in the lining clip 20, the crotch strap 101 is anchored to the bracket on the underside of the seat plate 2 and the frame piece 10 is locked to the lining clip 20 such that the bracket is locked firmly to the seat of the chair 2 as shown in FIG. 9. It should be noted that the crotch strap 101 is not locked to the bracket 10, but runs freely around the pin crosspiece 32, which enables adjustment of the crotch strap, such as adjustment of length for example. As may be seen in FIG. 9, the frame piece 10 has a recess 16 in order to hinder movement of the locking pin 30 when it is mounted. Both ends of the arms 31 are hindered in movement as they lie in deepening of the recess 16 in the frame piece 10 with stopping walls. The locking pin 30 is in this embodiment made of metal such that it has a flexibility which allows bending it enough to slip past the front end 13 of the frame piece 10 during mounting trough pin holes 24 which lie down into the recess 16, but also have enough stiffness for the locking pin 30 not to be bent or removed by hazard from the recess 16 without a certain power or use of tools, such as for example a flat screwdriver.

Figure 10:
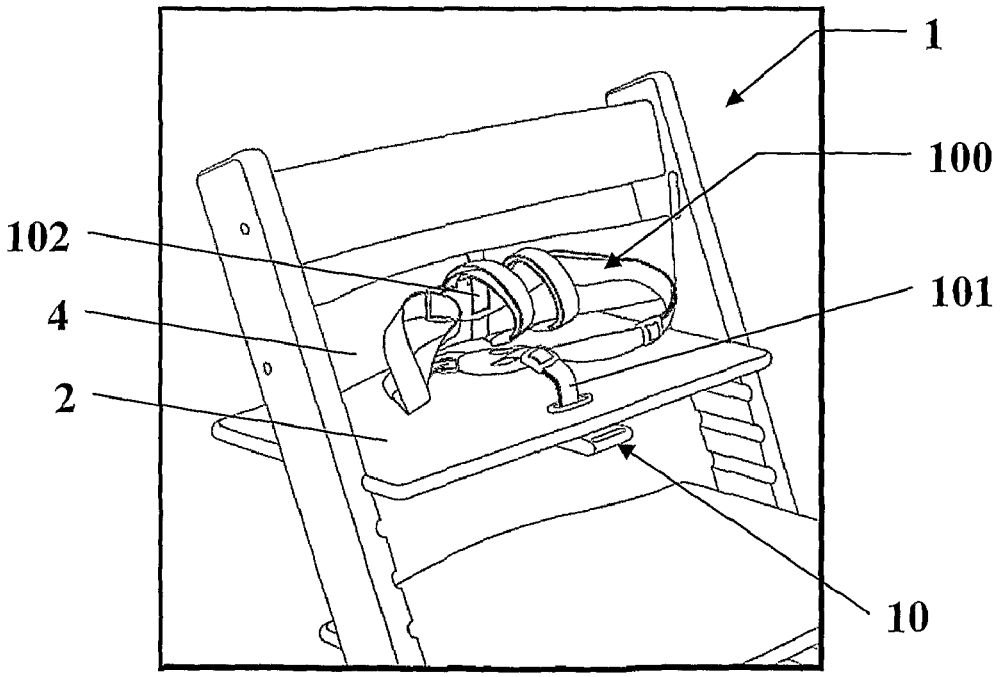
FIG. 10 shows a perspective view of the bracket mounted on a chair with harness.
Figure 11:
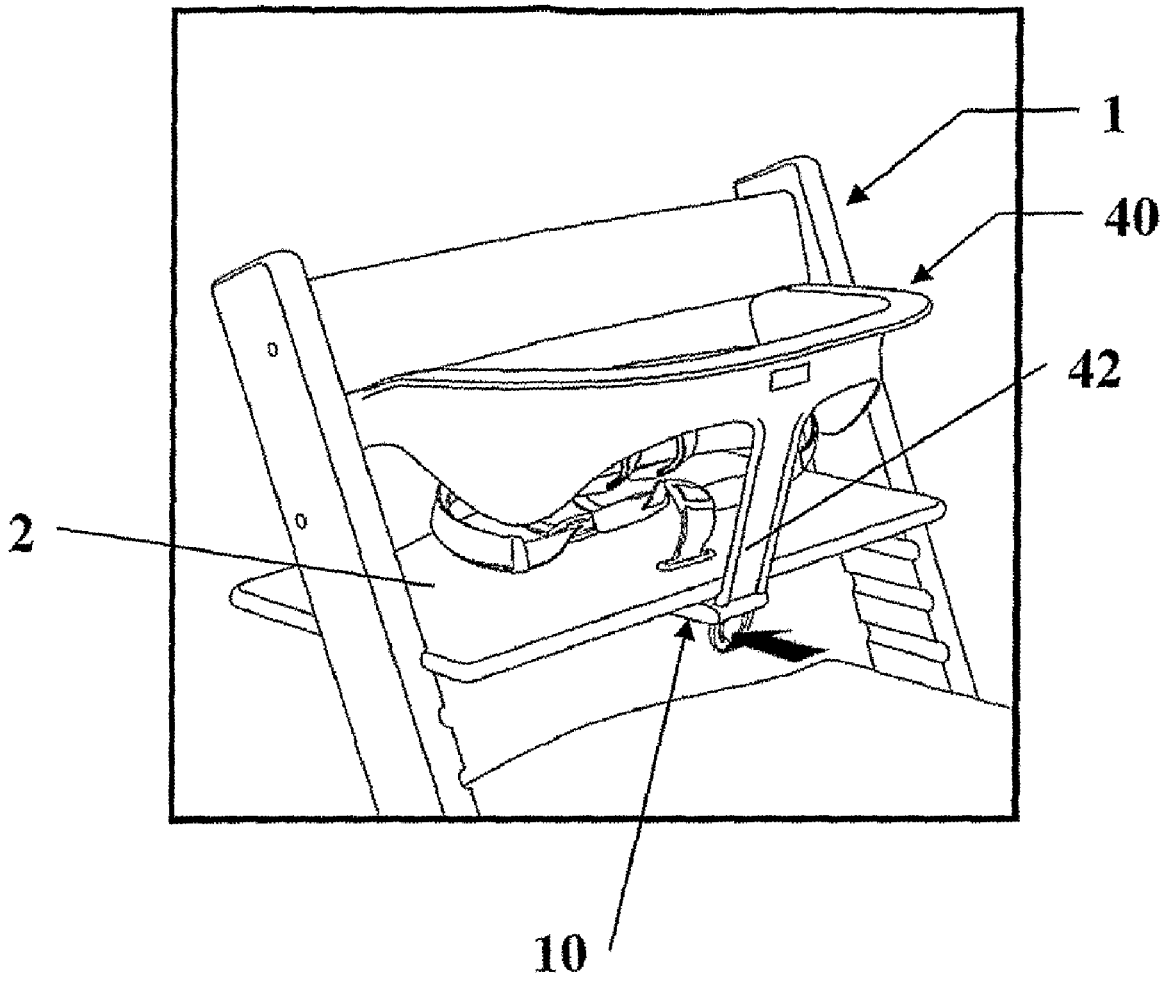
FIG. 11 shows a perspective view of the bracket mounted on a chair with harness and bow.

FIG. 10 shows a children's harness 100 mounted to a seat plate 2 via the crotch strap 101, which is anchored to the bracket 10 on the underside of the seat plate. As may be seen from FIG. 10, the front end 13 of the frame piece 10 with the edge opening 12 protrudes out on the underside of the seat plate 2. The edge opening 12 may be used to fasten other units to the seat plate, such as a part of a children's safety bow as shown in FIG. 11.

In this embodiment the bracket is adapted to the seat plate of a Tripp Trapp® chair. In addition being fixed to the seat plate, the harness is further adapted by having a back strap 102 which runs around at least one cross part 4 of the back support of the chair. By this fixing of the harness the child will obtain better freedom of movement in relation to traditional children's harnesses. There will also be fewer straps, which the child may soil or get fingers caught into.

Thus the invention also comprises a harness set for a children's chair comprising a harness 100 with a crotch strap 101 which may be anchored to the bracket 10 according to the invention and at least one strap 102 which runs around at least one cross piece 4 of the backrest of the chair 1 it is fastened to.

Further, the invention comprises the use of the fastening bracket and harness set.

The advantage with the bracket and the harness set according to the present invention is that they may be used on an existing chair, such as the Tripp Trapp® chair or other chairs, without making physical changes on any of the chair parts or use of fixing means such as screws. The bracket 10 is locked firmly only by the aid of three parts, and the fastening point for the harness 100 follows chair adjustments both vertically and horizontally, such as height adjustment or depth adjustment of the seat plate, without hindering any of the functions of the chair.

The bracket makes detachable fixing of a harness and a safety bow possible, either separately or together. This provides several practical solutions and enables the use of the chair to be adapted to several different users in a simple and flexible manner.

The bracket 10 and harness set may easily be removed after use or be moved to another corresponding chair when their us is no longer needed.

Further Embodiments

The present invention may contain further features in order to adapt the bracket or the harness set or to provide them with further functions.

As shown in FIGS. 1 and 2 the frame piece 10 may has a thickness which is reduced on the topside of the front end 13 in relation to the central part of the frame piece. The background for this shaping is to be able to allow a cushion to be fastened to the top surface of the seat plate 2, wherein the cushion may have a "pocket" along the entire front edge of the cushion by a "lip" being thread over the front edge of the seat plate 2. The room arising between the front edge 13 and the seat plate 2, thereby allows for such a cushion to be thread over the seat plate. As shown in FIGS. 1 and 2 the frame piece 10 has a protrusion 15 from the upper middle part and into the mentioned room. The protrusion 15 is an enforcement providing extra abutting surface towards the underside of the seat plate in order to hinder the front piece in breaking if the front end 13 is subjected to a load too large in the upward directed direction.

In an additional embodiment the frame piece 10 may alternatively be mounted with the front end 13 in a backward direction under the seat plate 2 if there is no (longer) need for the edge opening 12. If the length of the rear end 14 of the frame piece is shorter than the front end 13, in relation to the position of the middle opening, the entire rear end of the frame piece may be hidden by the seat plate 2 in a backward directed position. As the first opening 11 in the frame piece 10 is vertically and symmetrically shaped, the frame piece 10 may be mounted in both ways. The backward directed position will in this embodiment be aesthetically preferred if there is no need for extra fastening point on the seat plate, and the bracket will thereby be protected against spills from the child.

The shaping of the locking pin 30 may have different designs, and in one embodiment the arms 31 may be bent in the vertical direction in order to strain the ends further down into the recess 16. Possibly, parts or areas of the pin crosspiece 32 or the arms 31 may have a specific shape in order to be adapted to recesses or walls in the frame piece 10 so that a certain locking is achieved or special methods must be used to remove the locking pin 30. Such adapted areas may for example be raised parts, which allow the introduction of a flat screwdriver or pliers in order to flip the locking pin 30 over the edge of the recess 16 when the fastening bracket 10 is to be demounted. In the suggested embodiment the locking pin 30 consists of one continuous part. Possibly the locking pin 30 may comprise two separate arms 31 which are mounted together with a separate pin crosspiece 32, and alternatively the mounting of the pin crosspiece may induce the locking of the arms 31 to the frame piece 10.

The invention claimed is:

1. A fastening bracket for use in a children's chair, where the children's chair includes a seat plate having a vertical opening, wherein the fastening bracket comprises:

a frame piece with a vertical first opening, for placement on an underside of the seat plate;

a lining clip having two parallel vertical locking pegs configured for introduction into the vertical opening in the seat plate from above, wherein the locking pegs are connected together at a first end with a flange and each locking peg has a horizontal pin hole in a second end, wherein the flange has a horizontal dimension which is larger than that of the vertical opening in the seat plate, and wherein the flange has an additional vertical inner opening between the locking pegs, and a locking pin having at least two parallel arms for introduction into the pin holes in the lining clips, the arms being connected together with a pin crosspiece.

2. The fastening bracket according to claim 1, wherein both the first opening in the frame piece and the vertical inner opening in the flange of the lining clips allows throughput of a part of a harness, preferably a crotch strap.

3. The fastening bracket according to claim 2, wherein one or more of the locking pin and the pin crosspiece anchors the part of the harness to the bracket.

4. The fastening bracket according to claim 3, wherein the part of the harness may run freely around the crosspiece.

5. The fastening bracket according to claim 1, wherein the frame piece further comprises an edge opening.

6. The fastening bracket according to claim 5, wherein the edge opening in the frame piece allows for fastening a crotch strap of a safety bow.

7. The fastening bracket according to claim 5, wherein the edge opening is a cross-directed opening.

8. The fastening bracket according to claim 5, wherein the edge opening is a vertical slanted opening.

9. The fastening bracket according to claim 5, wherein the edge opening is adapted to protrude in front of the seat plate when the fastening bracket is mounted to the chair.

10. The fastening bracket according to claim 1, wherein the frame piece is substantially oblong in shape having a front edge and a rear end.

11. The fastening bracket according to claim 10, wherein the distance between the first opening and the front end is longer than the distance between the first opening and the rear end.

12. The fastening bracket according to claim 11, wherein the front end includes the edge opening.

13. The fastening bracket according to claim 10, wherein the front end of the frame piece is reduced in thickness in relation to a central part of the frame.

14. The fastening bracket according to claim 13, wherein the central part of the frame piece includes a protrusion towards the front end of the bracket.

15. The fastening bracket according to claim 10, wherein the bracket may be mounted back to front, and preferably that no parts of the fastening bracket protrude in front of the seat plate.

16. The fastening bracket according to claim 1, wherein the frame piece defines a recess, which hinders movement of the locking pin when mounted through the pinholes.

17. The fastening bracket according to claim 16, wherein the recess includes one or more of end walls for the arms, and tracks for raised parts for the pin crosspiece or arms.

18. The fastening bracket according to claim 1, wherein the locking pegs of the lining clips include extensions in the second end.

19. The fastening bracket according to claim 18, wherein the locking pegs of the lining clips include extensions that protrude away from the vertical inner opening between the locking pegs.

20. The fastening bracket according to claim 18, wherein the extensions may be directed through the first opening in the frame piece and clasp the front piece firmly to the lining clips.

21. The fastening bracket according to claim 1, wherein the arms and/or the pin crosspiece of the locking pin comprises bent portions for straining or locking the locking pin in the frame piece.

22. The fastening bracket according to claim 21, wherein the locking pin is made of a metal.

23. The fastening bracket according to claim 1, wherein the first opening in the frame piece and the inner opening in the lining clip allow for the fixing of a part of a safety bow.

24. The fastening bracket according to claim 23, wherein the first opening in the frame piece and the inner opening in the lining clip allow for the fixing of a crotch strap.

25. The fastening bracket according to claim 1, wherein the first opening in the frame piece and the inner opening in the lining clip allow anchoring of a part for a harness.

26. A harness set for a children's chair, the children's chair having a seat plate and backrest, wherein the harness set comprises a bracket according to claim 1 and a children's harness that includes a crotch strap adapted to be anchored in the bracket.

27. The harness set according to claim 26, wherein the children's harness includes at least one back strap running around at least one crosspiece of the back support in the children's chair it is fixed to.

28. The harness set according to claim 26, further comprising a safety bow.

29. The use of a fastening bracket according to claim 1 to mount at least one of a harness or a safety bow in a children's chair.

* * * * *